US008187156B2

(12) United States Patent
Hochberg et al.

(10) Patent No.: US 8,187,156 B2
(45) Date of Patent: May 29, 2012

(54) WHEELCHAIR GYM

(76) Inventors: Randall J. Hochberg, No Name Key, FL (US); Daniel T. Hayes, Red Lion, PA (US)

( * ) Notice: Subject to any disclaimer, the term of this patent is extended or adjusted under 35 U.S.C. 154(b) by 0 days.

(21) Appl. No.: 12/655,102

(22) Filed: Dec. 23, 2009

(65) Prior Publication Data

US 2010/0164201 A1 Jul. 1, 2010

Related U.S. Application Data

(60) Provisional application No. 61/140,914, filed on Dec. 26, 2008.

(51) Int. Cl.
*A63B 21/06* (2006.01)

(52) U.S. Cl. ..... 482/142; 482/134; 482/137; 280/304.1; 280/304.2

(58) Field of Classification Search ..... 280/304.1; 482/319; 272/72, 73, 130; 128/25 R
See application file for complete search history.

(56) References Cited

U.S. PATENT DOCUMENTS

| | | | | |
|---|---|---|---|---|
| 5,536,225 | A * | 7/1996 | Neuberg et al. | 482/71 |
| 5,645,516 | A * | 7/1997 | Foster | 482/79 |
| 6,645,127 | B1 * | 11/2003 | Pestes | 482/60 |
| 2002/0193210 | A1 * | 12/2002 | Turner | 482/80 |
| 2003/0087737 | A1 * | 5/2003 | Studdard | 482/142 |
| 2006/0276310 | A1 * | 12/2006 | Martin et al. | 482/92 |
| 2007/0099780 | A1 * | 5/2007 | Bowser | 482/148 |

* cited by examiner

*Primary Examiner* — Tony H. Winner
*Assistant Examiner* — Jacob Knutson
(74) *Attorney, Agent, or Firm* — Lowe Hauptman Ham & Berner, LLP

(57) ABSTRACT

A wheelchair gym having a support bar releasably connected to the frame of the wheelchair. A vertical post is attached to the support bar and hand grips are slidably mounted on the vertical post. The hand grips are resiliently biased and may be moved conjointly or opposite to one another to provide arm exercise for a patient in the wheelchair. The gym also has leg supports on which resiliently biased foot rests may be moved conjointly or opposite to one another. The leg supports may be moved up and down or may be splayed laterally.

12 Claims, 15 Drawing Sheets

WHEELCHAIR GYM

CROSS REFERENCE TO RELATED APPLICATION

This application is related to Provisional Patent Application Ser. No. 61/140,914 dated Dec. 26, 2008.

BACKGROUND OF THE INVENTION

This invention relates to an exerciser device attached to a wheelchair for use by persons confined to a wheelchair.

FIELD OF THE INVENTION

Many elderly Americans are in wheelchairs due to injuries, debilitating illnesses, or just generalized weakness, which often results in balance problems and fall risk. Several of these geriatrics have been through some form of rehabilitation (e.g., physical and/or occupational therapy) prior to being wheelchair bound and were unable to gain enough strength to be safe without the wheelchair. A primary reason they don't gain enough strength is that rehab time is constrained by insurance and Medicare protocols. For example, if a patient fractures a hip, after three days of hospitalization, Medicare A entitles the patient to skilled rehab (daily rehab up to 100 days at approximately one hour a day per PT/OT service). After the 100 days, Medicare B starts and rehab therapists can see the patient for three days per week. Once the patient stops progressing in strength gains or meeting rehab goals, Medicare stops payment. The patient is then confined to a wheelchair the rest of their life. The problem is one to two hours of rehab three times per week is usually not enough for wheelchair bound patients to make enough strength gains to be safe out of their wheelchair. They should be moving and exercising throughout the day as most healthy persons do just by performing everyday activities. Sitting in a wheelchair eight hours per day and then bedtime causes their muscles to atrophy.

The patient needs a way to exercise throughout the day. A simple setup apparatus that allows the patient to perform easy exercises that strengthen major muscle groups in both legs and arms would be beneficial. Exercising throughout the day will help the patient to gain enough strength to be free of the wheelchair. In addition, several patients do rehab well, but once they return to home or their assisted living apartments, they don't continue to exercise and get weak, subsequently fall, and end up on rehab again. It's a vicious cycle which is very common in many assisted living facilities. If elderly assisted living residents would remain strong, there would be less falls, injuries, and ultimately less wheelchair dependent geriatrics. Further, family members are always asking for ways they can help their elderly relatives exercise in their rooms to assist in rehab or progress/maintain their strength. Finally, physical and occupational therapists need additional ways to exercise/strengthen patients in their assisted living rooms without carrying loads of equipment to each patient's room, which in many cases, can be far apart in the larger assisted living facilities.

DESCRIPTION OF RELATED ART

Prior art has been directed to attachments to a wheelchair to provide exercise for the patient. The applicant is aware of the following:

| U.S. Pat. No. | Inventor(s) | Issue Date |
|---|---|---|
| 4,402,502 | Peters | Sep. 06, 1983 |
| 4,846,156 | Kopnicky | Jul. 11, 1989 |
| 5,242,179 | Beddome et al | Sep. 07, 1993 |
| 5,839,995 | Chen | Nov. 24, 1998 |
| 6,142,914 | Crawford et al | Nov. 07, 2000 |

Although these patents have existed for years, improved wheelchairs are not marketed. The present invention allows changing a typical wheelchair into a portable home exercise gym with just a few simple modifications and additions. By modifying the leg rests, the patient will be able to perform: 1) bilateral leg press, 2) hip abduction/adduction, 3) pedal a restorator/bike. Further, by adding an arm rest framework, the patient will be able to perform 4) rowing, 5) chest press, 6) lat. pulldown, 7) deltoid/military press, 8) arm bike/restorator. These modifications will allow the patient to strengthen all major muscle groups necessary to help get out of the wheelchair safely. The modification strengthens and rigidifies the chair to support the exercise attachments.

BRIEF SUMMARY OF THE INVENTION

In accordance with the teachings of the present invention there is disclosed in a gym combination with a wheelchair having a frame. The gym is detachably secured to the wheelchair to enable a patient using the wheelchair to perform at least one exercise repeatedly and at patient selected times during the day for strengthening at least one major muscle of the patient in order to supplement and enhance whatever physical therapy the patient is receiving, thereby substantially decreasing the patient's recovery time. The gym has a support bar releasably connected to the frame of the wheelchair wherein the wheelchair is rigidly supported in an open position. The support bar has an adapter formed at approximately a midpoint thereof. A vertical post is removably connected to the adapter. The vertical post extends upwardly from the support bar in front of the seat. Hand grips for exercising the patient's arms are attached to the vertical posts. Leg supports for the patient's legs are attached to the opposite ends of the support bar and extending outwardly from the support bar. Resiliently biased foot rests are movably connected to each of the leg supports wherein the foot rests may be moved up and down conjointly and may be moved up and down opposite to one another. Further, the leg supports for exercising the patient's legs may be swung to and fro and may be moved laterally in a splayed manner followed by an inward movement.

In further accordance with the teachings of the present invention, there is disclosed a removable attachment to enable a patient confined temporarily or permanently in a wheelchair to exercise his or her legs and/or arms, respectively. The attachment comprises a pair of resiliently-biased foot rests on which the patient's feet are adapted to be supported, such that the patient's feet may be moved generally up and down and, alternately, laterally to and fro in a splayed manner. The attachment has a pair of resiliently-biased handles which may be gripped, respectively, by the patient's hands for back and forth movement generally forwardly of the patient's head and neck area for exercise of his or her arms.

In still further accordance with the teachings of the present invention, there is disclosed an exercise attachment for a patient confined to a wheelchair, comprising a substantially leg-exercising structure having a pair of substantially parallel spaced-apart leg portions. The exercise attachment further has a support bar adapted to be removably locked to the frame of the wheelchair and generally forwardly of the patient's torso wherein the wheelchair is held in a rigidly open position. A pair of resiliently-biased foot rests, one for each of the leg portions of the leg-exercising structure is slidably mounted for reciprocal movement therein, such that the patient's feet may be supported by the foot rests, respectively, and such that the patient may move his or her feet up and down against the resilient bias thereof for exercise of his or her legs.

Additionally, in accordance with the teachings of the present invention, there is disclosed an arm exercising attachment to a wheelchair, comprising a support bar adapted to be removably locked to the frame of the wheelchair and generally forwardly of the patient's torso wherein the wheelchair is held in a rigidly open position. A post is adapted to be removably connected to the support bar substantially midway thereof and extending upwardly therefrom substantially forwardly of the patient's head and neck areas. A member is attached to the top of the post and extending outwardly therefrom. The member includes a pair of spaced-apart resiliently-biased handles mounted for reciprocation on the member, such that the patient may reach up and grip the handles for exercise of his or her arms.

These and other objects of the present invention will become apparent from a reading of the following specification taken in conjunction with the enclosed drawings.

DESCRIPTION

Figure 1:
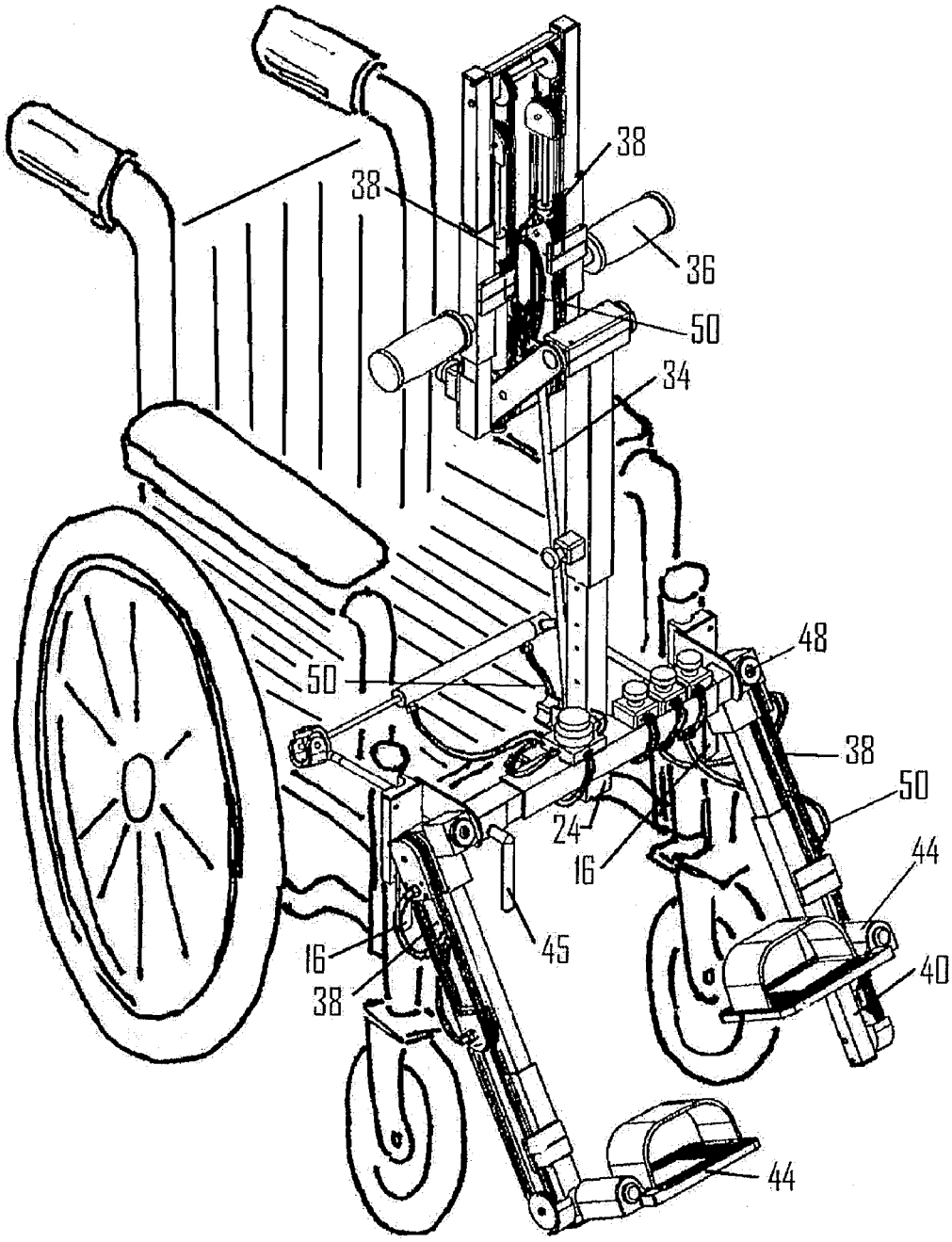
FIG. 1 is a perspective view showing the present invention mounted on a wheelchair.
Figure 2:
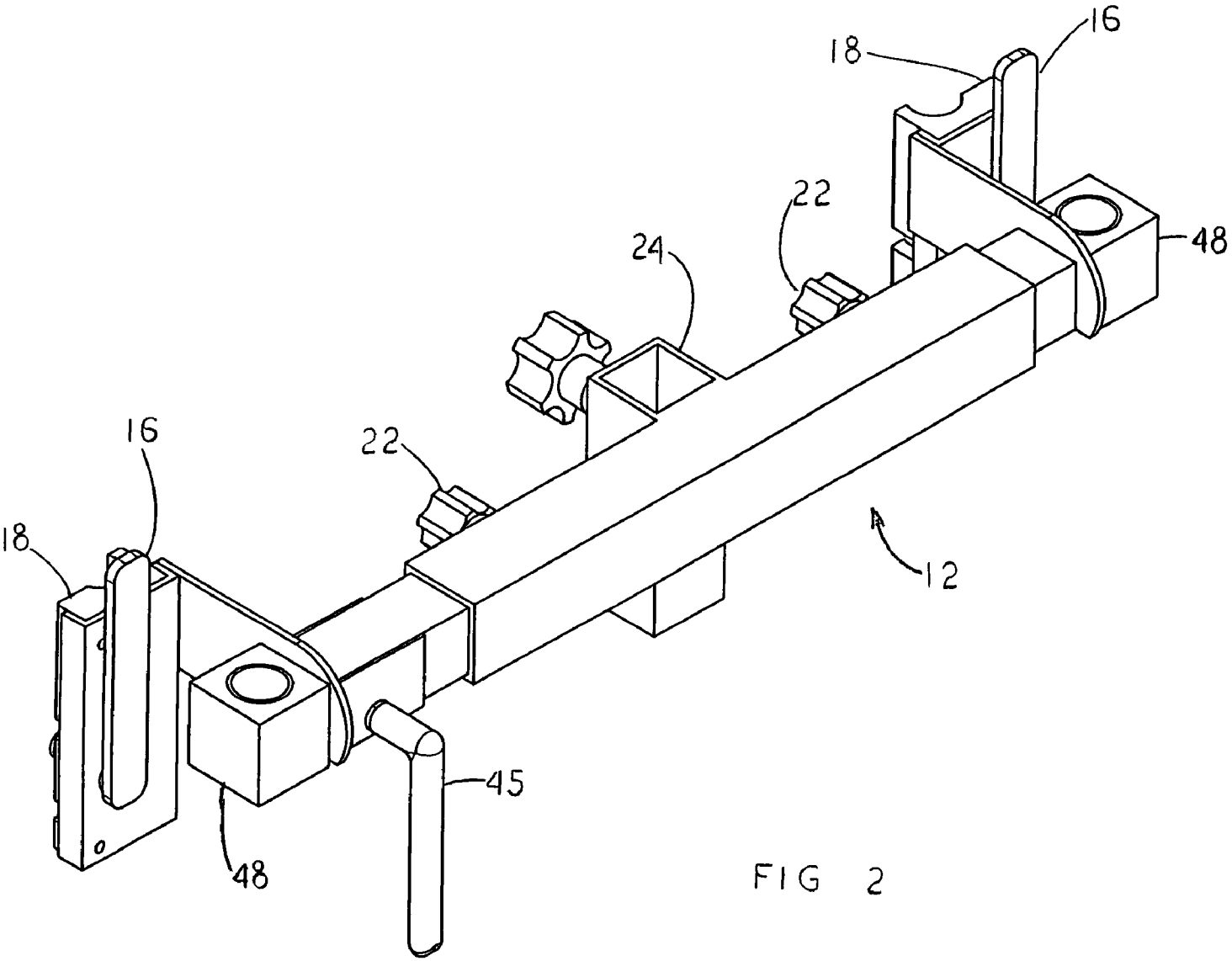
FIG. 2 is a perspective view of the support bar of the present invention.
Figure 3:
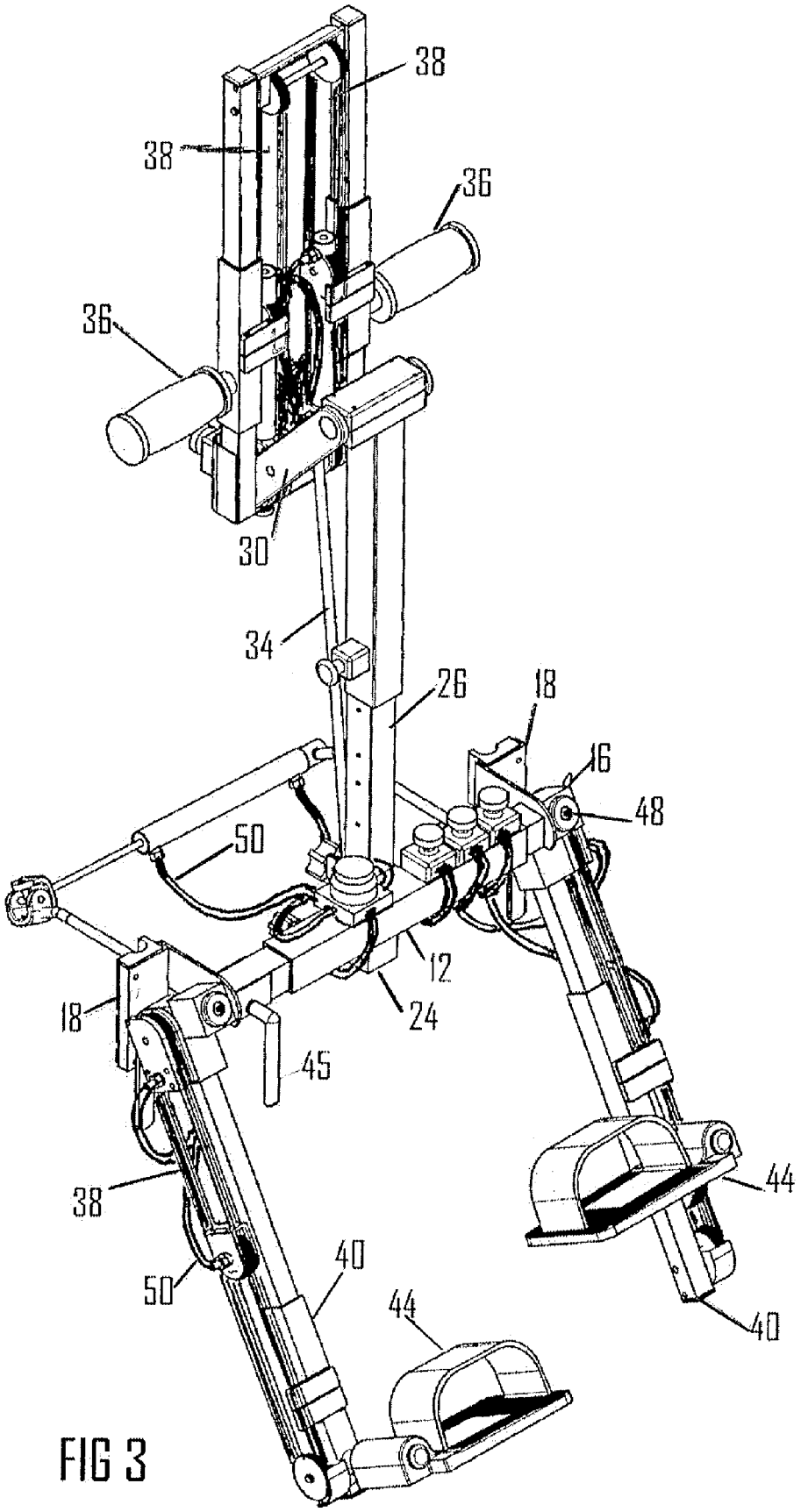
FIG. 3 is a perspective view of the present invention showing the upper portion of the vertical post in an upright position and the foot rests in a staggered position.
Figure 4:
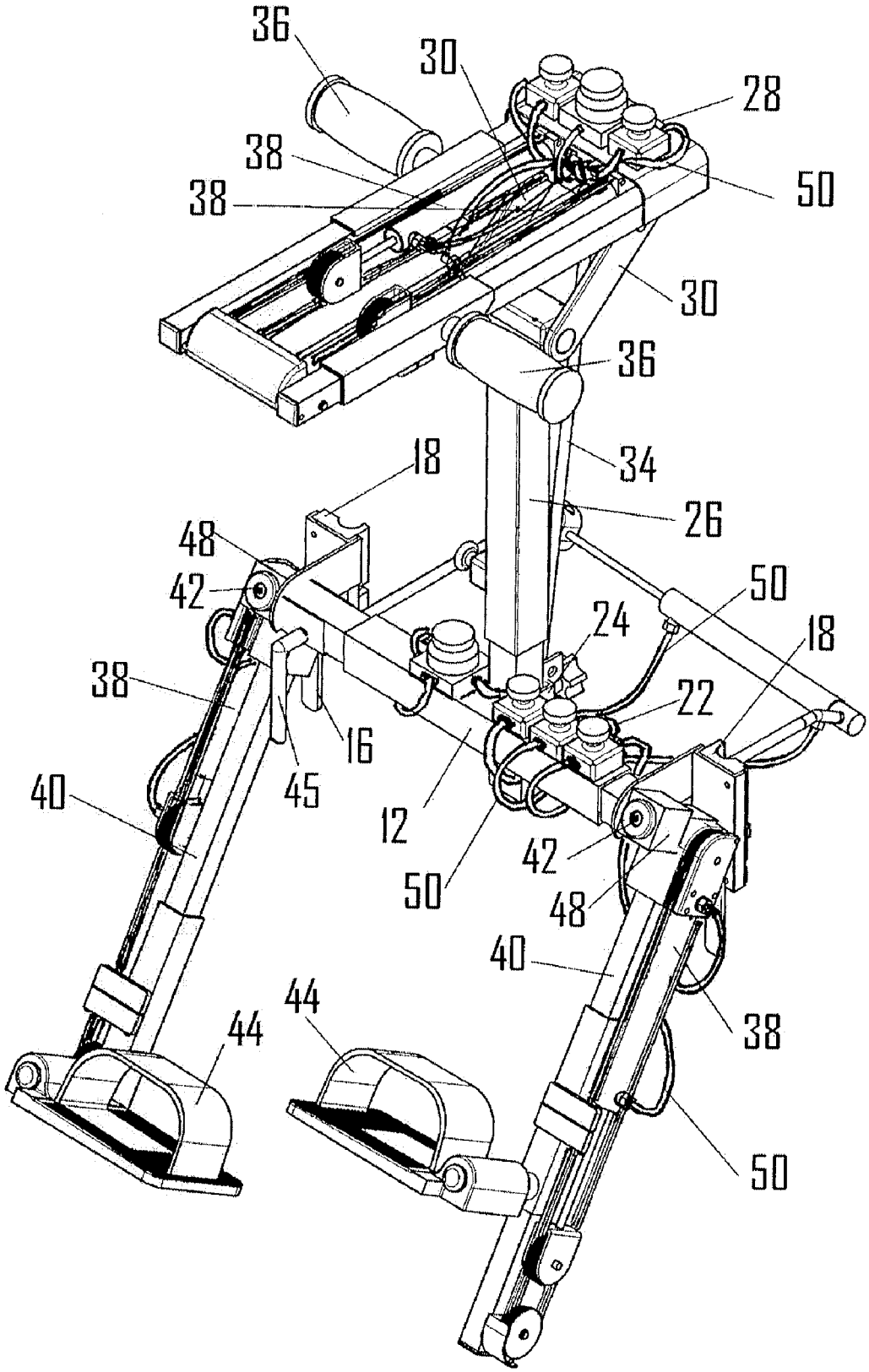
FIG. 4 is a perspective view of the present invention showing the upper portion of the vertical post in an angular position and the foot rests in a staggered position.
Figure 5:
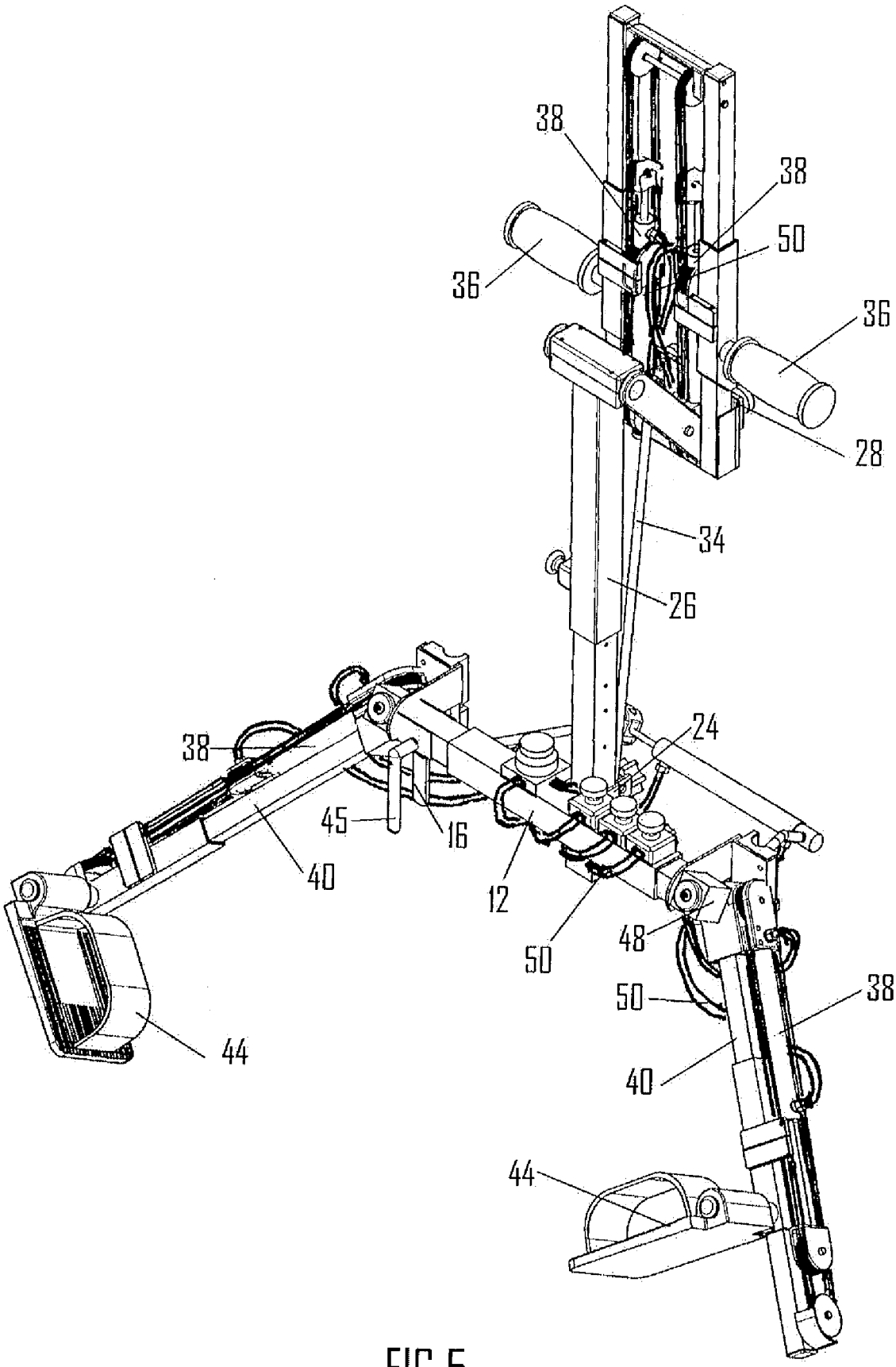
FIG. 5 is a perspective view of the present invention showing the upper portion of the vertical post in an upright position and the leg supports in a splayed position.
Figure 6:
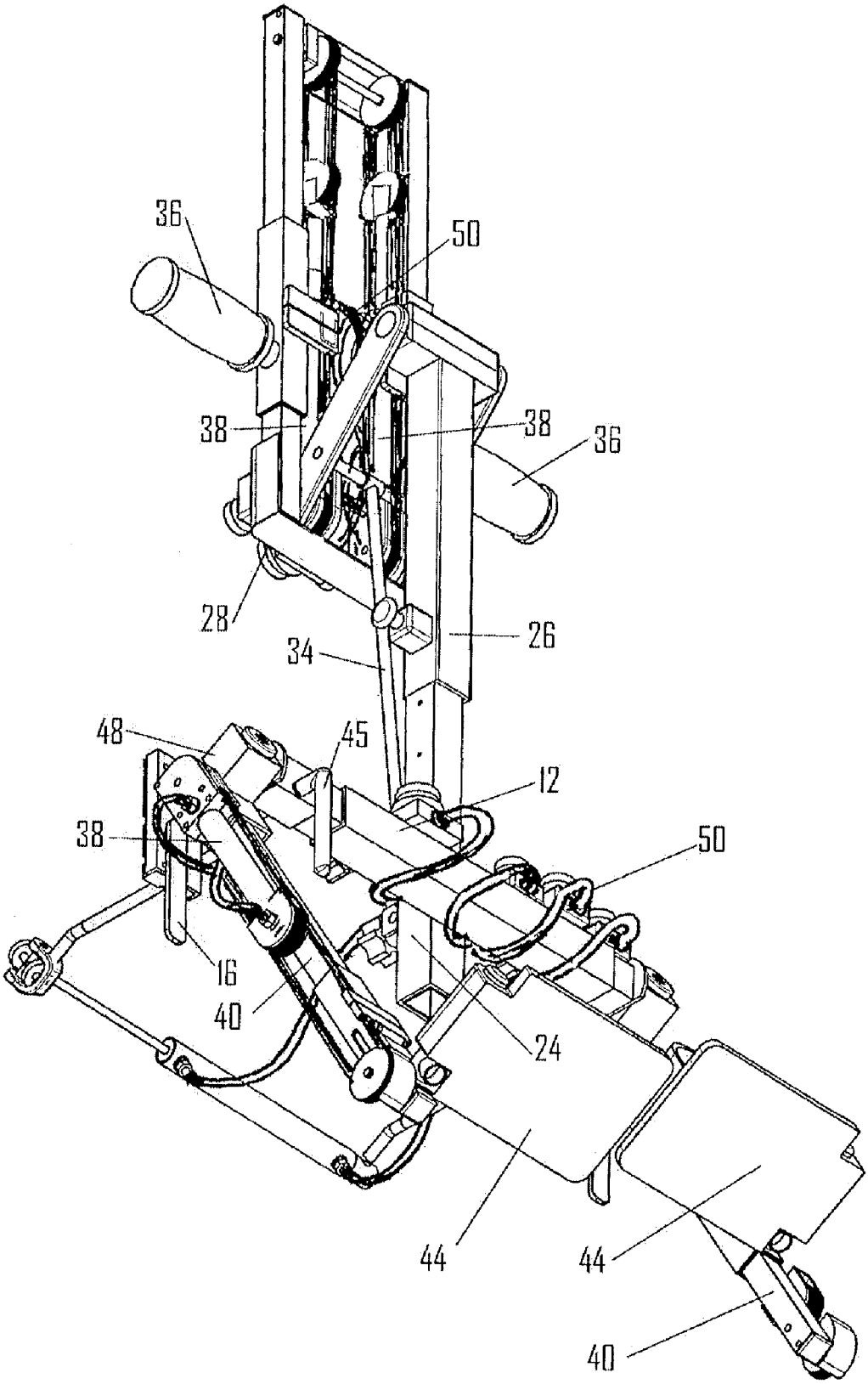
FIG. 6 is a perspective view of the present invention viewed from the bottom and showing the reverse side of the invention.
Figure 8:
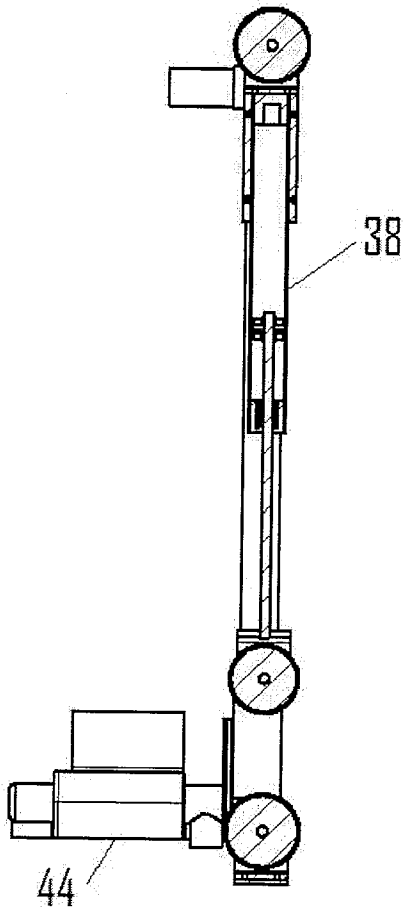
FIG. 8 is a cross section view of FIG. 7 taken along lines 8-8 of FIG. 7.
Figure 7:
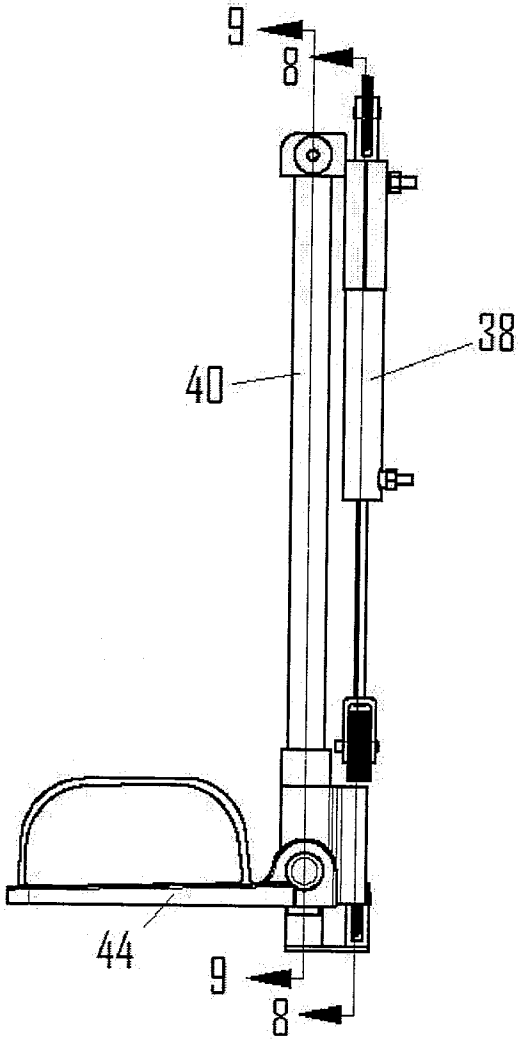
FIG. 7 is a side view of a leg support of the present invention.
Figure 9:
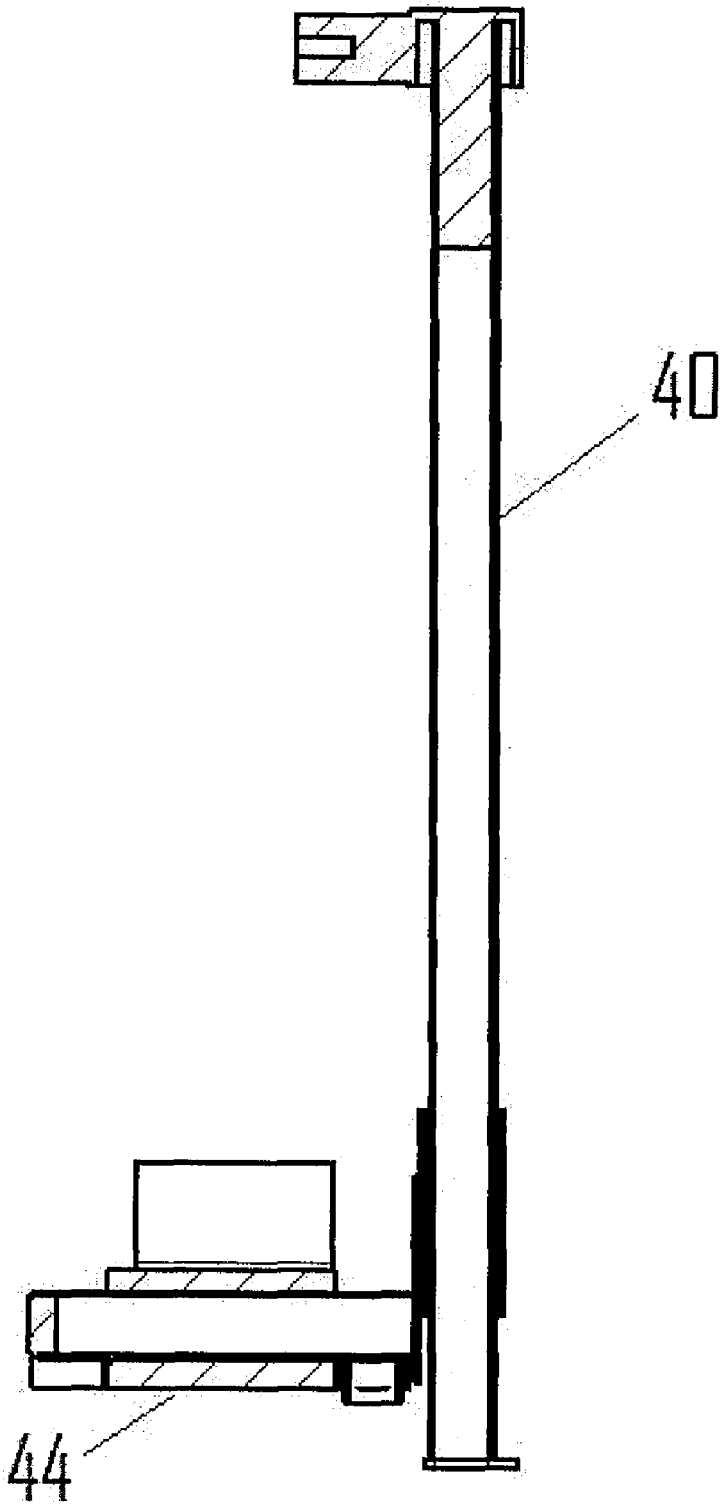
FIG. 9 is a cross section view of FIG. 8 taken across the lines 9-9 of FIG. 8.
Figure 10A:
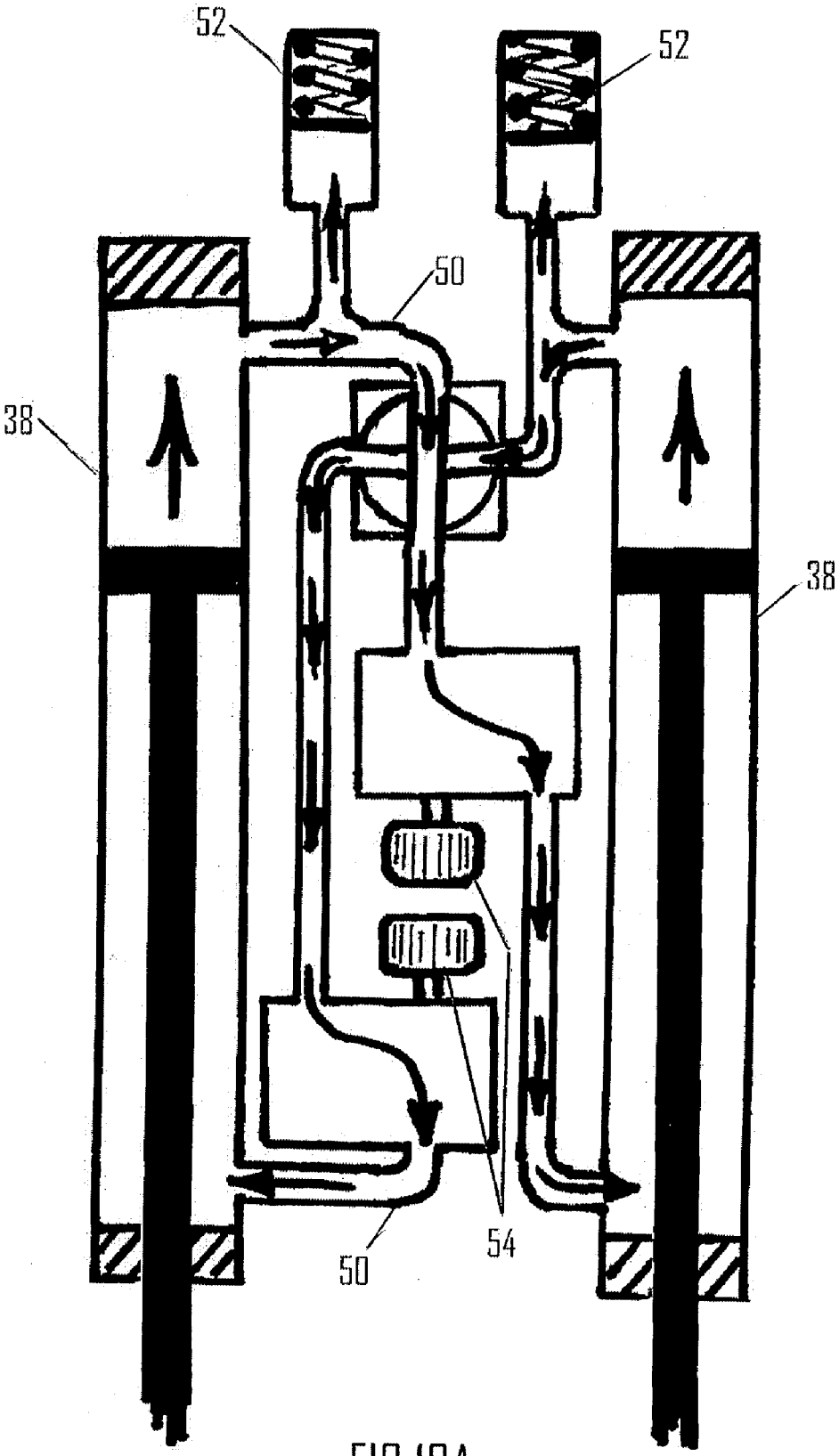
FIG. 10 are schematic drawings of the hydraulic lines connecting the resiliently based hydraulic cylinders showing the direction of movement of the piston in the cylinder and the direction of movement of fluid in the hydraulic lines.
Figure 10B:
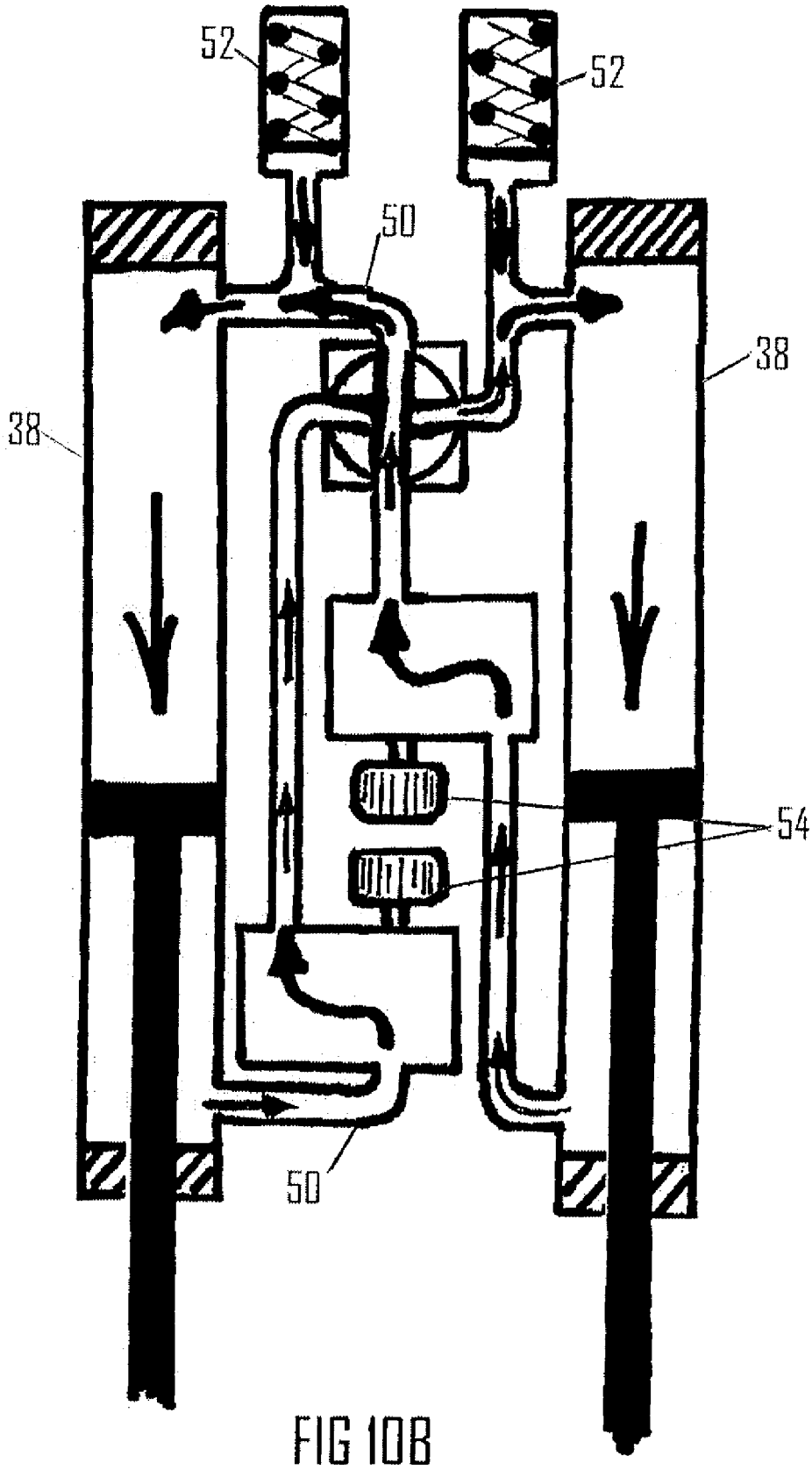
Figure 10C:
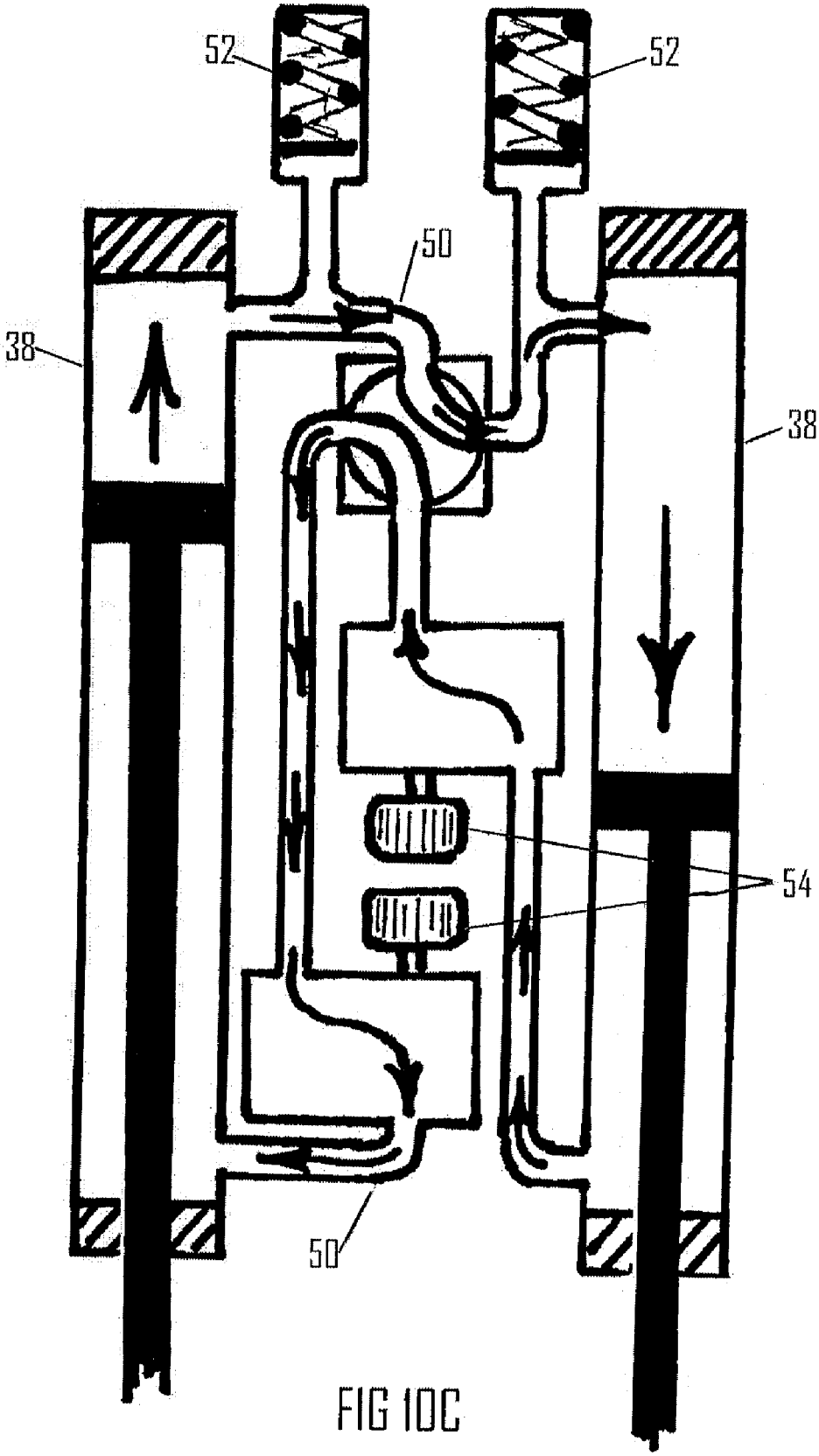
Figure 10D:
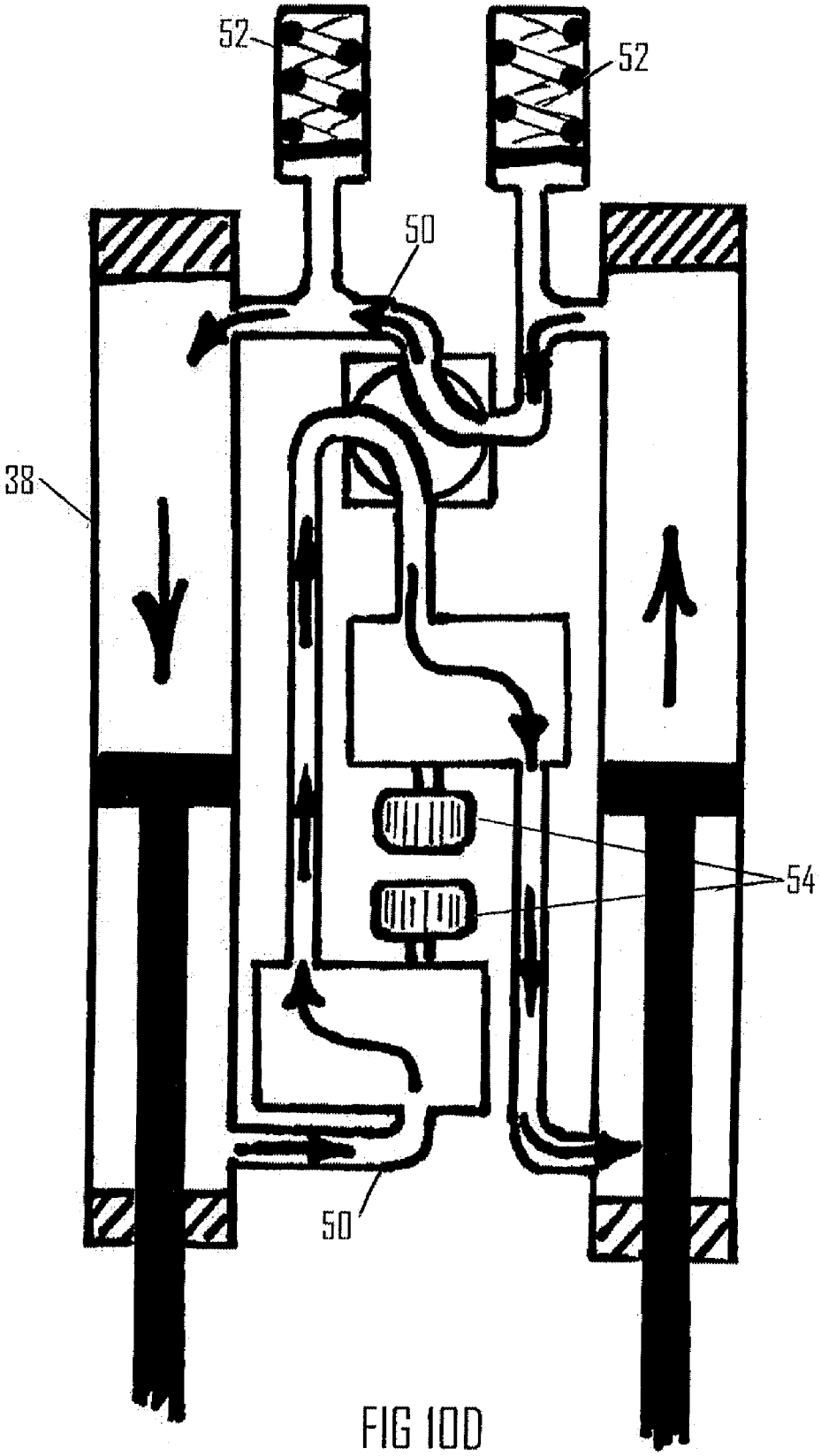
Figure 10E:
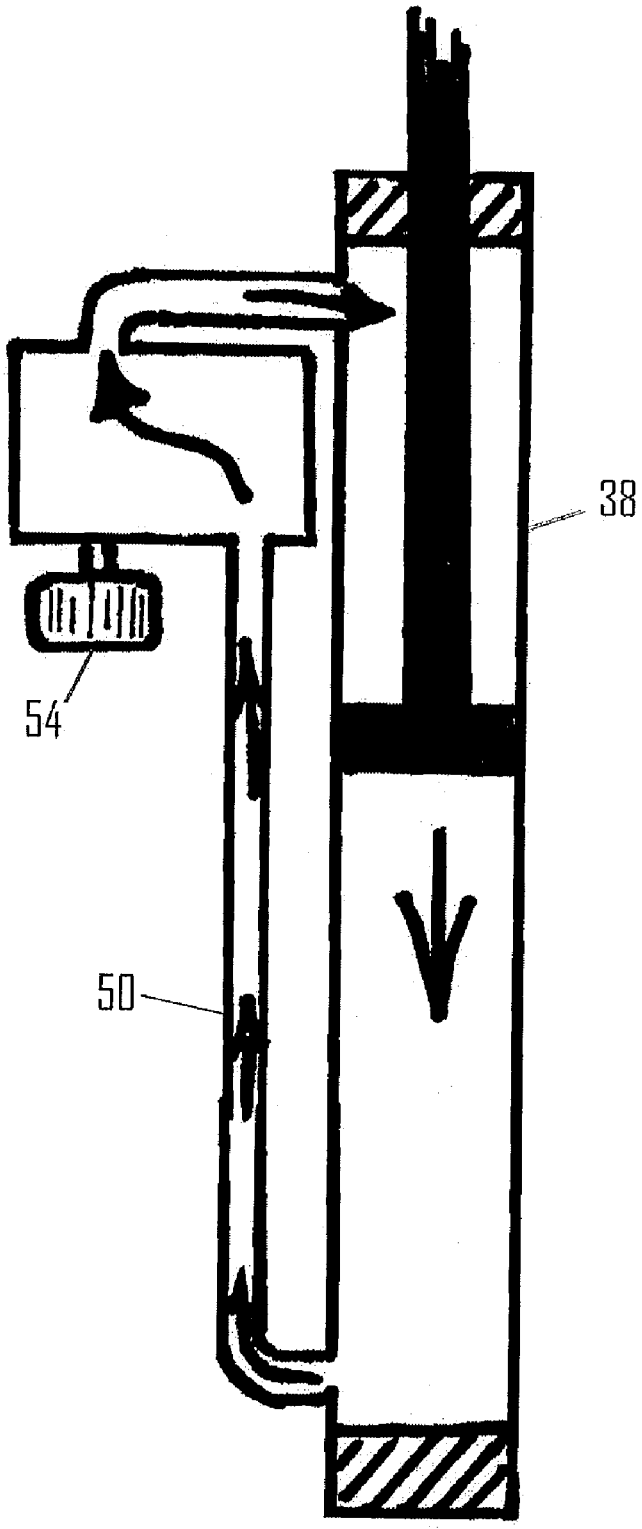
Figure 10F:
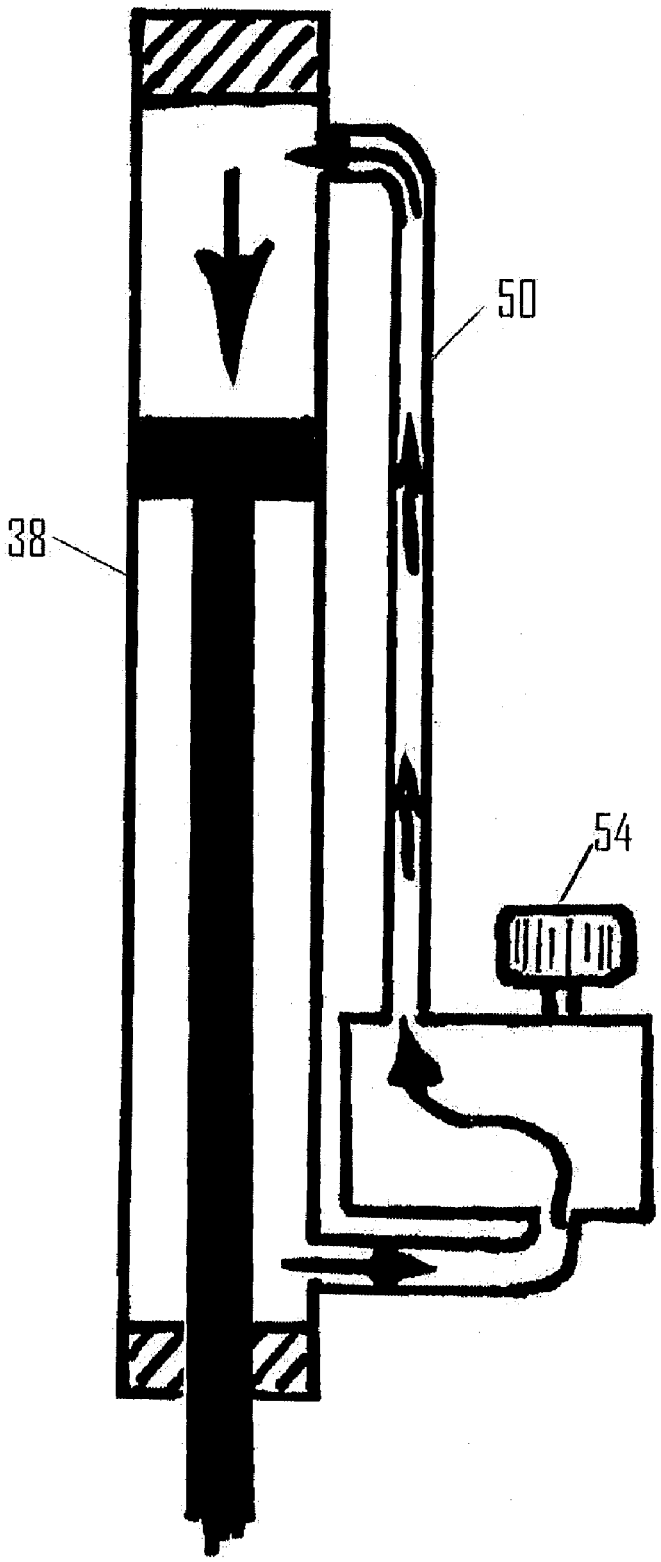
Figure 11:
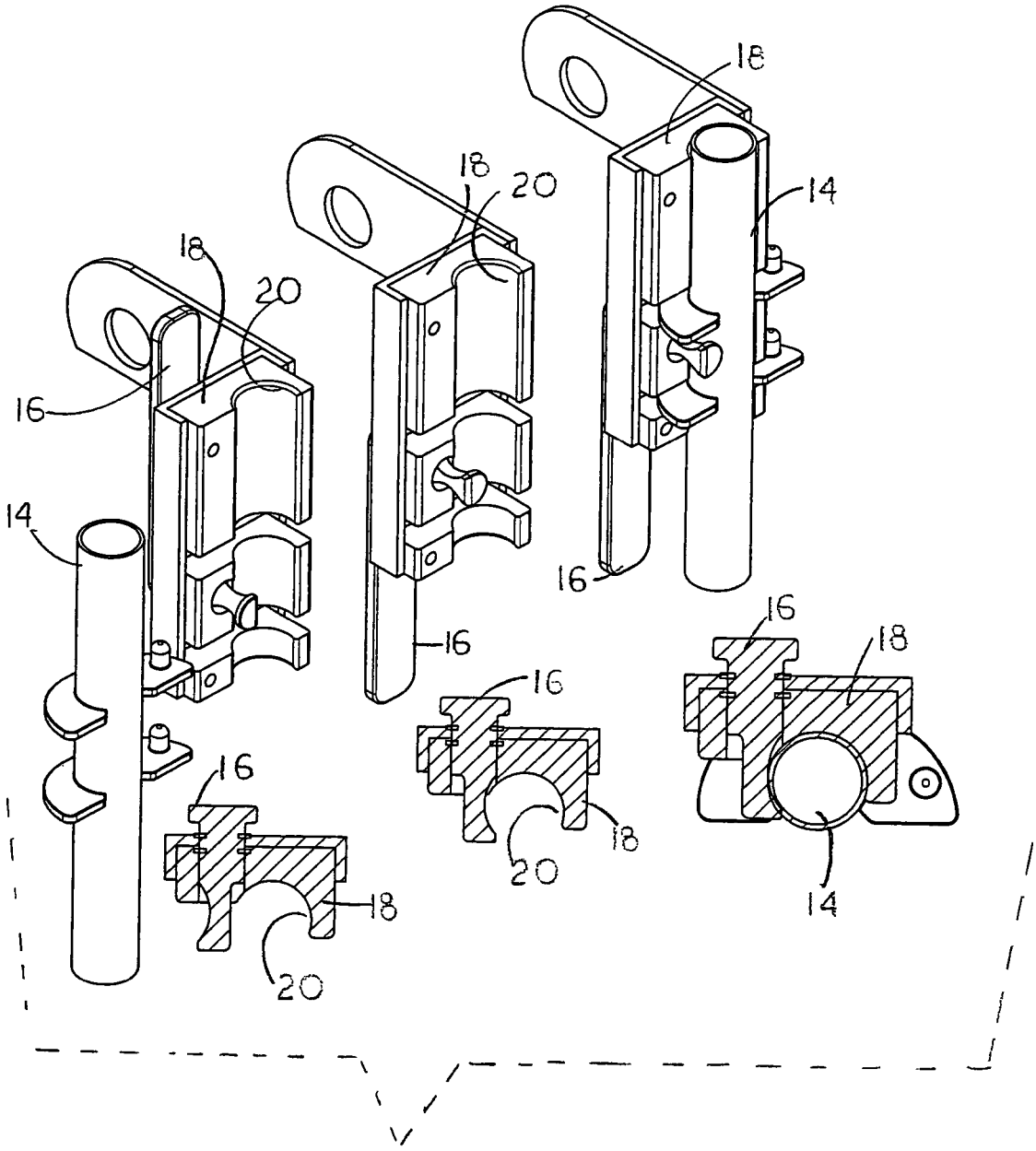
FIG. 11 is a sequence of perspective and cross sectional views showing locking of the support bar to the frame of the wheelchair.

Referring now to FIGS. 1-9, a standard wheelchair is adapted to become an exercise gym by the use of the present invention. A support bar 12 (FIG. 2) which is connected to the frame 14 of the wheelchair immediately in front of the seat of the wheelchair and in front of the torso of the patient in the wheelchair. The support bar has a lever arm 16 on each opposite end. Each lever arm 16 is connected to a vertical plate 18 having a concave channel 20 formed therein. As the lever arm 16 is moved, the frame 14 of the wheelchair is engaged in the concave channel to lock the support bar between the opposite sides of the wheelchair to rigidly maintain the wheelchair in an open position and to prevent the wheelchair from folding in two. FIG. 11 is a sequence of views showing the frame 14 of the wheelchair being received in the concave channel 20. Rotation of the lever arm moves the lever arm against the frame of the wheelchair in a camming type action. The length of the support bar is adjustable to fit a wheelchair of any standard width and the length of the support bar can be locked in the desired length by tightening screws 22 on the support bar.

At approximately the mid-point of the support bar, there is formed an adapter 24 to receive a vertical post member 26 (FIGS. 3-6). The vertical post is substantially forward of the patient's head and neck area. The vertical post supports arm exercise attachments as will be described. The vertical post is removably secured to the adapter on the support bar to prevent movement of the vertical post. The height of the vertical post is adjustable to accommodate the size of the patient in the wheelchair.

An upper portion 28 of the vertical post is pivotably connected to the vertical post by at least one strap 30 which is connected to a pivot pin 32 which extends through the vertical post. A rod 34 has a first end connected to the vertical portion and a second T-shaped end pivotably connected to the at least one strap 30 distal from the vertical post 26.

The first end of the rod 24 is adjustably connected to the vertical post to control the angular positioning of the upper portion 28 of the vertical post with respect to the vertical post. As the first end of the rod 34 is connected proximal to the support bar 12, the upper portion 28 is more nearly in a vertical alignment and as the first end of the rod is connected more distal from the support bar, the upper portion is disposed at a greater angle with respect to the vertical post.

The upper portion of the vertical post has a hand grip 36 attached to opposite sides of the upper portion. Each hand grip is slidably movable along the length of the opposite sides of the upper portion. A respective hydraulic pump 38 is connected to each hand grip providing resilient biasing. Hydraulic lines 50 connect the hydraulic pumps to each other and to a reservoir 52 so that each hand grip may slide along the respective side of the upper portion either in unison with the opposite hand grip or independently thereof.

The sequence of drawings shown in FIG. 10 show the direction of movement of fluid in the hydraulic lines 50 and the direction of movement of the piston within the hydraulic cylinder 38. FIG. 10A shows the arm or leg cylinder in a pushing direction for an arm or leg press. FIG. 10B is similar to FIG. 10A except the press is in a pull direction. FIG. 10C show the system in a forward bicycling movement and FIG. 10D shows the system in the reverse bicycling movement. FIG. 10 E shows a leg scissor action drawing away and FIG. 10F is the leg scissor action drawing forward. In this manner, the patient may grasp the hand grips and exercise the arms either alternately in a punching bag manner or together as in an arm press. Also shown in FIG. 10 are adjustment knobs. These are the pressure regulators. They utilize a ball held in place by an adjustable spring to regulate the minimum pressure (force on the footrest or handle grip) necessary to initiate movement. Once that pressure is reached, movement can be continued without any additional increase in force. In this manner, there is a constant resistance to motion along the entire length of travel, and resistance can be adjusted by a simple turning of the knob. The upper portion of the vertical post may pivot about the pivot pin 38 through at least 90° from a horizontal to a vertical position.

At each end of the support bar 12, there is a pivot block 48 with an opening therethrough. The two pivot blocks are connected by a shaft which extends internally through the support bar. Each pivot block 48 is connected by a pivot pin to a respective leg support 40. A locking handle 46 is formed on the support bar. The locking handle may be turned to engage the shaft which connects the pivot blocks. When in an unlocked position, the leg supports connected to the pivot blocks, may be moved from a position substantially in a horizontal plane to a position which is at an angle of approximately 60° with respect to the horizontal plane. In this manner, the patient may elevate or lower his/her legs. Further, each leg support 40 may be moved sideways about the pivot pin connecting the respective leg support to the respective pivot block. A foot rest 44 is slidably mounted on each leg support wherein the patient's foot is received on the foot support and the foot may be slidably moved along the length of the leg support. Each foot rest is connected to a hydraulic cylinder 38 in a manner similar to the hand grips on the vertical post providing resilient bias for each foot rest. The patient may exercise his/her legs by moving each foot independently up and down on the leg support in a walking manner. Alternately, the patient may move both legs simultaneously upwardly and downwardly in a rowing-like movement. Further, the patient may move each leg independently from the center to an outward position, or both legs may be moved outwardly concurrently. A locking handle 45 is formed on the support bar. When the locking handle is engaged, rotation of the support bar is prevented and the leg supports cannot be elevated or raised from the position in which the leg supports are set at the time of locking.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In combination with a wheelchair, comprising: a frame, the frame having a front, a back and opposite sides supporting a seat and a backrest, a gym having a support bar, a vertical post, rigid leg supports and resilient-biased foot rests independently detachably secured to the wheelchair to enable a patient using the wheelchair with the gym to perform at least one exercise repeatedly and at patient selected times during the day for strengthening at least one major muscle of the patient in order to supplement and enhance whatever physical therapy the patient is receiving, thereby substantially decreasing the patient's recovery time, the gym having the single support bar releasably connected at seat level to the frame of the wheelchair wherein the wheelchair is rigidly supported in an open position, the support bar having an adapter formed at approximately a midpoint thereof, the vertical post connected to the support bar by the adapter, the vertical post extending upwardly from the support bar in front of the seat, a pair of hand grips for exercising the patient's arms attached to the vertical post, the rigid leg supports for exercising the patient's legs attached to the opposite ends of the support bar and extending outwardly from the support bar, the resiliently biased foot rests being movably connected to each of the leg supports wherein the foot rests may be moved up and down conjointly and may be moved up and down opposite to one another, further wherein the leg supports for exercising the patient's legs may be swung to and fro and may be moved laterally in a splayed manner followed by an inward movement.

2. The combination of claim 1, wherein the support bar has opposite ends, a lever arm being attached to each opposite end of the support bar, each lever arm being connected to a vertical plate having a concave channel formed therein wherein when the support bar is disposed in the wheelchair, the frame of the wheelchair is received in the respective concave channels and rotation of the respective lever moves the respective vertical plates to lock the frame of the wheelchair into the channel in the respective vertical plate.

3. A first removable attachment to a wheelchair to enable a patient confined temporarily or permanently in a wheelchair to exercise his or her legs, comprising a support bar removably attached to a frame of the wheelchair, a pair of rigid leg supports pivotally connected to the support bar, a pair of resiliently-biased foot rests on which the patient's feet are adapted to be supported, such that the leg supports may be moved generally up and down and, alternately, laterally to and fro in a splayed manner, and a second removable attachment to the wheelchair to enable the patient in the wheelchair to exercise his or her arms, comprising a vertical post connected to the support bar, a pair of resiliently-biased handles attached to the vertical post, wherein the resiliently-biased handles which may be gripped, respectively, by the patient's hands for back and forth movement generally forwardly of the patient's head and neck area for exercise of his or her arms.

4. An exercise attachment for a patient confined to a wheelchair, comprising a substantially leg-exercising structure having a pair of substantially parallel spaced-apart leg portions and further having a single support bar adapted to be removably locked to a frame of the wheelchair in front of a seat of the wheelchair, the adjustable support bar removably attached to said frame of said wheelchair, a pair of resiliently-biased foot rests, one for each of the spaced-apart leg portions of the leg-exercising structure and slidably mounted for reciprocal movement therein, such that the patient's feet may be supported by the foot rests, respectively, and such that the patient may move his or her legs up and down against the resilient bias thereof for exercise of his or her legs.

5. The exercise attachment of claim 4, wherein the resilient bias comprises respective hydraulic cylinders.

6. The exercise attachment of claim 4, wherein the up and down movement of the foot rests is synchronized for conjoint movement in unison.

7. The exercise attachment of claim 4, wherein the up and down movement of the foot rests is opposite to one another.

8. The exercise attachment of claim 4, further including means for pivotably mounting the legs relative to the support bar of the leg-exercising structure, such that the patient may swing his or her legs to and fro outwardly of the leg-exercising structure in a splayed manner followed by inward movement thereof.

9. The exercise attachment of claim 4, further including an arm-exercising structure, comprising a post member adapted to be removably connected to the support bar of the leg-exercising structure substantially midway thereof and extending upwardly therefrom substantially forwardly of the patient's head and neck areas, and a member attached to the top of the post and extending outwardly therefrom, the member including a pair of spaced-apart resiliently-biased handles mounted for reciprocation on the member, such that the patient may reach up and grip the handles for exercise of his or her arms.

10. The exercise attachment of claim 9, wherein the resiliently-biased handles are mounted for conjoint synchronized back-and-forth movement on the member.

11. The exercise attachment of claim 9, wherein the resiliently-biased handles are mounted for back-and-forth movement opposite to one another.

12. An arm exercising attachment to a wheelchair, comprising an adjustable support bar adapted to be removably locked to the frame of the wheelchair, a post adapted to be removably directly connected to the support bar midway thereof in front of a seat of the wheelchair and extending upwardly therefrom, and a member attached to the top of the post and extending outwardly therefrom, the member including a pair of spaced-apart resiliently-biased handles mounted for reciprocation on the member, such that the patient may reach up and grip the handles for exercise of his or her arms.

* * * * *